United States Patent [19]

Dahlback et al.

[11] 4,141,353

[45] Feb. 27, 1979

[54] WARNING ARRANGEMENT FOR BREATHING APPARATUS FOR DIVERS

[75] Inventors: Gunnar Dahlbäck, Stockholm; Ivan A. Hellquist, Sollentuna, both of Sweden

[73] Assignee: AGA Aktiebolag, Sweden

[21] Appl. No.: 849,630

[22] Filed: Nov. 8, 1977

[30] Foreign Application Priority Data

Nov. 9, 1976 [SE] Sweden ..... 7612476

[51] Int. Cl.[2] ..... B63C 11/14; B63C 11/20

[52] U.S. Cl. ..... 128/142 R; 137/492.5; 128/142.4

[58] Field of Search ..... 128/142.2, 142, 142.3, 128/142.4, 142.7, 147, 145 R, 203, 145.8; 137/492.5, 464; 116/65, 117 R, DIG. 7

[56] References Cited

U.S. PATENT DOCUMENTS

| | | | |
|---|---|---|---|
| 3,366,108 | 1/1968 | Blackburn et al. | 128/142 |
| 3,719,160 | 3/1973 | Christianson | 128/142.2 X |
| 3,788,312 | 1/1974 | Sandstrom | 128/142.3 |
| 4,031,887 | 6/1977 | Botos et al. | 128/142 R |

FOREIGN PATENT DOCUMENTS

| | | | |
|---|---|---|---|
| 2344150 | 5/1974 | Fed. Rep. of Germany | 128/142.2 |

*Primary Examiner*—Henry J. Recla

*Attorney, Agent, or Firm*—Larson, Taylor & Hinds

[57] ABSTRACT

A warning valve arrangement is provided in a breathing apparatus for divers. The breathing apparatus includes a breathing circuit which functions as a closed circuit during a rebreathing phase and a dosing or supply bottle which is alternately connected through a dosing valve to (i) a breathing gas container, from which the dosing bottle is filled, and (ii) the breathing circuit, into which the contents of the dosing bottle are discharged. The breathing circuit comprises a warning valve, which in a closed state at least obstructs inhalation from a breathing bag connected to the breathing circuit. A timing and pressure sensing control device is connected to a supply conduit which interconnects the dosing bottle and the breathing circuit, and, responsive to pressure variations in this supply conduit, causes the warning valve to assume the open state for enabling rebreathing in the breathing circuit.

7 Claims, 1 Drawing Figure

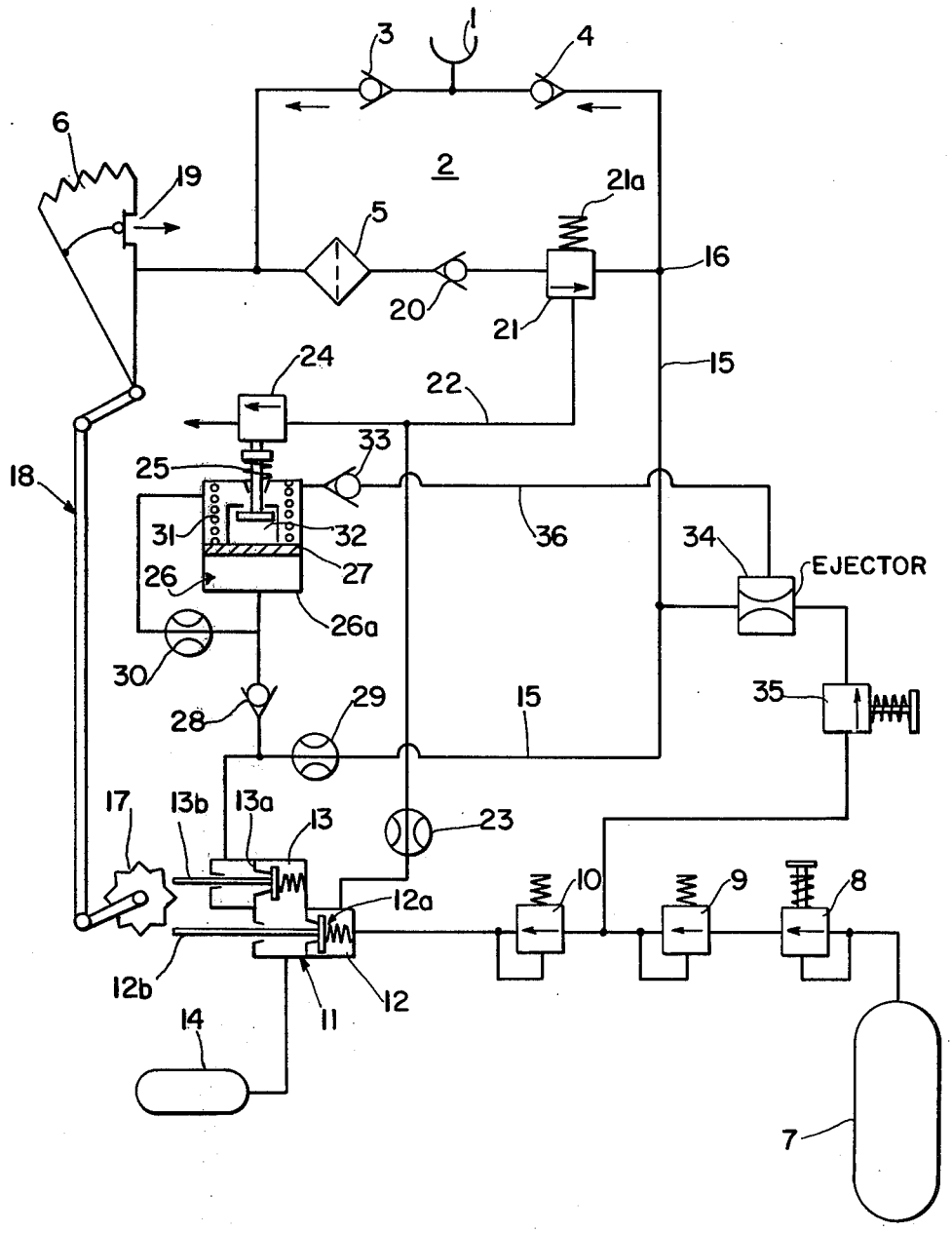
1
2
3
4
5
6
7
8
9
10
11
12
12a
12b
13
13a
13b
14
15
15
16
17
18
19
20
21
21a
22
23
24
25
26
26a
27
28
29
30
31
32
33
34
35
36
EJECTOR

WARNING ARRANGEMENT FOR BREATHING APPARATUS FOR DIVERS

FIELD OF THE INVENTION

The present invention relates to breathing apparatus for divers and, more particularly, to a warning arrangement for such breathing apparatus.

BACKGROUND OF THE INVENTION

The present invention is particularly concerned with a breathing apparatus for divers of the type comprising a closed breathing circuit and a dosing bottle. In such apparatus, a dosing valve is adapted to alternately connect the dosing bottle to (i) a source of breathing gas for filling the dosing bottle or to (ii) the breathing circuit so that the contents of the dosing bottle is supplied to the breathing circuit. The breathing circuit characteristically comprises non-return valves for directing the gas flow in the breathing circuit as well as a container with a carbon dioxide absorbing substance, and a breathing bag.

A breathing apparatus of this kind is disclosed, for instance, in commonly assigned U.S. Pat. No. 4,031,887 (Botos et al). Apparatus of this type functions in such a way that a rebreathing takes place in the closed breathing circuit until the oxygen content of the breathing gas of the breathing circuit decreases to a predetermined value. Meanwhile, the dosing bottle is filled from a source of breathing gas. When the oxygen content decreases to the predetermined value, the breathing gas which has been stored in the dosing bottle is supplied to the breathing circuit at the same time as the used breathing gas is forced out to the surrounding medium. Thereafter, a new rebreathing period is started at the same time as the dosing bottle is refilled with breathing gas.

SUMMARY OF THE INVENTION

In breathing apparatus of the kind disclosed above, it is essential that the diver receive a warning signal if for some reason the supply of breathing gas from the dosing bottle is not sufficient. The deficiency in the supply can be due to several factors. For example, the operation of the dosing valve can be inadequate to produce the desired supply or the gas pressure of the source of breathing gas may be reduced to such a low value that a warning signal should be given. The present invention is concerned with providing a warning signal under circumstances such as those discussed hereinbefore.

As dicussed above, the warning device of the invention is provided in a breathing apparatus for divers of the type which includes a breathing circuit that functions as a closed circuit during a rebreathing phase, and a dosing or supply bottle which alternately connects through a dosing valve to (i) a breathing gas container from which the dosing bottle is filled and (ii) the breathing circuit into which the contents of the dosing bottle is discharged. The warning device comprises a warning valve which in the closed state thereof at least obstructs or prevents inhalation from a breathing bag connected to the breathing circuit. A timing and pressure sensing control device is also provided which is connected to a supply circuit that interconnects the dosing bottle and the breathing circuit and which, responsive to pressure variation in this supply conduit, causes the warning valve to assume the open state thereof.

Other features and advantages of the invention will be set forth in, or apparent from, the detailed description of the preferred embodiments found hereinbelow.

BRIEF DESCRIPTION OF THE DRAWINGS

The invention will now be described with reference to the drawings wherein a schematic circuit diagram of a breathing apparatus according to the invention is illustrated.

DESCRIPTION OF A PREFERRED EMBODIMENT

In the exemplary embodiment to be considered, the breathing apparatus in which the invention is incorporated comprises a breathing mask 1 which is connected with, or forms a part of, a breathing circuit 2. The breathing circuit 2 comprises non-return valves 3 and 4 which provide a flow of breathing gas in the direction of the arrows. The breathing circuit 2 also comprises an absorber 5 which is adapted for absorbing carbon dioxide and a breathing bag 6 which stores the exhaled gas and from which the inhalation takes place through the absorber 5.

The breathing gas is supplied to the breathing circuit 2 from a source or gas container of breathing gas denoted 7. This breathing gas is assumed to consist of a mixture of oxygen and nitrogen in proportions which may be equal to, of differ from, the proportions between these gases in normal air. The breathing gas from the gas container 7 is directed to a reserve valve 8. As indicated in the drawing, the reserve valve 8 is kept open in a conventional manner by means of the gas pressure in the conduit between the gas container 7 and the reserve valve 8, and valve 8 is closed under the influence of a spring force if the gas pressure in said conduit falls below a predetermined value. When closed, the reserve valve 8 can be opened manually, and against the influence of the spring force, so that the remainder of the gas in the gas container 7 can be supplied to the breathing circuit 2.

The breathing gas passes from the reserve valve 8 through a first pressure regulator 9 and a second pressure regulator 10 to a dosing valve 11. The dosing valve 11 comprises a first chamber 12 which can be connected with a second chamber 13 in the dosing valve 11 through a spring actuated valve **12*a*. A second spring actuated valve 13*a* is arranged in the outlet of the chamber 13. A dosing bottle 14 is connected with the chamber 13 while a connecting conduit 15 connects the dosing valve 11 to a junction point 16** in the breathing circuit.

In a manner which is described in the previously mentioned U.S. Pat. No. 4,031,887, the valves **12*a*, 13*a* in the two chambers 12, 13 in the dosing valve 11 are actuated by a cam wheel 17 which is controlled by the movements of the breathing bag 6 in such a way that the valves 12*a*, 13*a* in the two chambers 12 and 13 are opened alternatively. During a first time interval, which coincides with the rebreathing that takes place in the breathing circuit 2, valve 12*a* in chamber 12 is open while valve 13*a* in chamber 13 is closed. This means that the breathing gas from the gas container 7 can be supplied to the dosing bottle 14 via the reserve valve 8 and the pressure regulators 9 and 10. It may be assumed that these pressure regulators are so adjusted that the pressure on the order of 200 atmospheres in the gas container 7 is reduced in the pressure regulator 9 to an intermediate pressure on the order of eight atmospheres. This intermediate pressure is further reduced in the pressure regulator 10** to about three atmospheres.

Cam wheel 17 is rotated by a linkage or lever system 18 indicated schematically in the drawings. When a predetermined number of rebreathings has taken place in the breathing circuit 2, during which time cam wheel 17 has been successively rotated through a predetermined angle, the cooperation between the cam wheel 17 and a pair of push rods 12*b* and 13*b* actuated thereby results in closing of valve 12*a* in the chamber 12 and opening of valve 13*a* in the chamber 13. In this way, the gas contained in dosing bottle 14 is supplied to the breathing circuit 2 through the dosing valve 11 and the connecting conduit 15. The breathing gas supplied to breathing circuit 2 will force out used breathing gas which leaves the system through an exhaust valve 19. A non-return valve 20 prevents the supplied breathing gas from flowing directly through the absorber 5 to the breathing bag 6. As indicated in the drawings, the exhaust valve 19 is arranged to be opened when the breathing bag 6 has reached its most expanded state. Until this has happened, the exhaust valve 19 is kept closed so that the breathing circuit 2 functions as a closed circuit while rebreathing takes place in the breathing circuit 2.

In order to provide a warning signal to the diver which indicates that breathing gas has not been supplied to the breathing circuit 2 in a predetermined amount, a warning valve 21 is inserted in the breathing circuit 2 in the path between breathing mask 1 and the absorber 5 and breathing bag 6. The warning valve 21 is actuated by a spring 21*a* indicated schematically in the drawing and by the gas pressure in a control conduit 22. As long as a sufficiently high pressure prevails in control conduit 22, warning valve 21 is open so that the diver can freely inhale gas from the breathing bag 6. However, if the pressure in the control conduit falls below a predetermined value, valve 21 is then actuated by spring 21*a* so that the valve 21 is completely or partly closed, whereby the inhalation from the breathing bag 6 is prevented or obstructed. In a known manner, the warning valve 21 may be so designed that a limited flow of breathing gas through the valve is possible under all circumstances. Even where this is done, the diver will feel a considerable resistance during the inhalation so that the desired warning signal will still be received by him.

The control conduit 22 is connected with the chamber 12 in the dosing valve 11 through a choke 23. In addition, a relief valve 24 is connected with the control conduit 22, the outlet of relief valve 24 being open to the surrounding medium. The relief valve 24 is actuated by a spring 25, which tends to close the valve, as well as by a timing actuating device 26 which operates to open the valve 24 and to keep the valve 24 open during a predetermined time. Timing device 26 comprises a cylinder 26*a* and a piston 27 movable therein. The lower part of cylinder 26*a* is connected with the dosing valve 11 through a non-return valve 28. A choke 29 is inserted in the connecting conduit 15 from the dosing valve 11 to the breathing circuit 2.

The lower part of the cylinder 26*a* is also connected with the upper part of the cylinder 26*a*, i.e., the part above the piston 27, through a conduit including a choke 30 therein. The piston 27 is actuated by a spring 31 which tends to move piston 27 downwards. The piston 27 controls the relief valve 24 through a coupling 32 provided with vertical play so that the relief valve 24 can be opened when the piston 27 is moving towards the lowermost position thereof.

When the valve 12*a* in chamber 12 is closed and the valve 13*a* in chamber 13 is open, the contents of the dosing bottle 14 is emptied through the dosing valve 11 to the connecting conduit 15. The pressure increase which then occurs before the choke 29 generates a gas stroke through the non-return valve 28 to the cylinder 26*a* so that the piston 27 is pushed rapidly upwards. The compression spring 25 can then close the relief valve 24, which means that the pressure in the control conduit 22 will influence the warning valve 21 so that valve 21 is opened. As a result of this operation, the rebreathing in the breathing circuit 2 can go on without any obstruction. During the time when the rebreathing takes place, the gas in the cylinder space below the piston 27 leaks slowly through the choke 30 to the space above the piston 27 so that this piston moves downwards under the influence of the spring 31. If no new pressure stroke is supplied through the non-return valve 28, the piston 27 will finally open the relief valve 24 through the coupling 32. Then the pressure in the control conduit 22 falls suddenly to a minimum value determined by choke 23. This minimum value is such that the spring 21*a* which acts on the warning valve 21 can close the valve 21 so that the diver receives a warning signal. However, the apparatus will be so designed that, under normal circumstances, the rebreathing in the breathing circuit 2 is completed before the relief valve 24 opens. This means that the dosing bottle 14 is again emptied and causes a pressure increase in the connecting conduit 15 so that no warning signal is given.

From the foregoing it is obvious that the diver will receive a warning signal if the dosing bottle 14 is not emptied in a normal way. Further, a warning signal is given if the gas pressure at the output of regulator 10 falls below a predetermined value. In this case the force of the spring 21*a* which acts on the warning valve 21 will be stronger than the force of the gas pressure in the control conduit 22 so that the warning valve 21 is closed. Under these circumstances, the diver can open the reserve valve 8 manually in order to use the remainder of the gas in the gas container 7.

In order to enable the warning valve 21 to be opened, a suction conduit 36 is connected with the space in the cylinder 26*a* above the piston 27. This suction conduit 36 includes a non-return valve 33 therein and is connected with the suction side of an ejector 34 which is inserted between the supply conduit 15 and the conduit between the regulators 9 and 10, through a manually actuable valve 35. When the valve 35 is opened, breathing gas, which is at the higher pressure prevailing at the output of the regulator 10, flows through the ejector 34 into the breathing circuit 2. At the same time, gas will be sucked through the non-return valve 33 so that the piston 27 is moved upwards. As a result of this operation, the spring 25 can close the relief valve 24 so that the increasing pressure in the control conduit 22 can open the warning valve 21 in the manner described hereinabove.

Although the invention has been described relative to an exemplary embodiment thereof, it will be understood that other variations and modifications can be effected in this embodiment without departing from the scope and spirit of the invention.

We claim:

1. In an arrangement in a breathing apparatus for divers comprising a breathing circuit functioning as a closed circuit during a rebreathing phase, a source of breathing gas, a dosing bottle, dosing valve means, said source and said dosing bottle being operatively connected to said dosing valve means, a supply conduit operatively connected between said dosing valve means and said breathing circuit, wherein said dosing valve means alternately connects said dosing bottle to said source of breathing gas for filling the dosing bottle and to the breathing circuit so as to discharge the contents of the dosing bottle to the breathing circuit, said breathing circuit comprising non-return valve means for controlling the direction of flow in said circuit, an absorber containing a carbon dioxide absorbing substance, and a breathing bag, the improvement wherein the breathing circuit further comprises warning valve means, for in the closed state thereof, at least obstructing inhalation from the breathing bag and wherein a timing and pressure sensing control means is operatively connected to said supply conduit disposed between the dosing valve means and the breathing circuit, for, responsive to a sufficient pressure in said supply conduit due to the discharging of the dosing bottle, causing the warning valve means to assume an open state thereof and for maintaining said warning valve means in said open state during a predetermined time interval and for, responsive to an inadequate pressure in said supply conduit due to the discharging of the dosing bottle, causing the warning valve means to assume a closed state thereof whereby, inhalation from the breathing bag is obstructed and thereby, warning the diver of a low pressure in the breathing gas supply.

2. An arrangement according to claim 1 wherein said time interval is longer than the normal time interval between two consecutive discharges from the dosing bottle.

3. An arrangement according to claim 1 wherein the warning valve means comprises a normally closed valve, a control conduit connected between said valve and said source of breathing gas for maintaining the valve in an open position and spring means for biassing said valve to the closed position thereof.

4. An arrangement according to claim 3 wherein a release valve is operatively connected to said control conduit, and means for opening said release valve by said timing and pressure sensing control means and spring means normally biassing said release valve closed.

5. An arrangement according to claim 4 wherein the timing means comprises a piston movable in a cylinder defining first and second chambers, respectively, coupling means in said first chamber having a predetermined play therein operatively connecting said piston to the release valve to open said release valve.

6. An arrangement according to claim 5 wherein a choke is connected in the supply conduit, a first conduit connecting said second chamber to said supply conduit upstream of said choke, said first conduit having a non-return valve therein permitting flow from said supply conduit to said second chamber, spring means biasing said piston towards said second chamber, a second conduit having a choke therein connecting said second chamber to said first chamber, a third conduit connecting said first chamber to said supply conduit and having a non-return valve therein permitting flow from said first chamber to said supply conduit.

7. An arrangement according to claim 6, wherein a fourth conduit including an ejector having a suction input connected between said source of breathing gas and said supply conduit, said third conduit being connected to said suction input, and wherein said fourth conduit further includes a manually actuable by-pass valve for supplying breathing gas directly to the breathing circuit.

* * * * *